US006766903B1

(12) United States Patent
Yehhsu

(10) Patent No.: US 6,766,903 B1
(45) Date of Patent: Jul. 27, 2004

(54) CONTAINER HAVING SEPARATE STORAGE CHAMBERS

(76) Inventor: Li-Li Yehhsu, 9F-6, No. 2, Lane 150, Sec. 5, Xin-Yi Rd., Taipei (TW)

( * ) Notice: Subject to any disclaimer, the term of this patent is extended or adjusted under 35 U.S.C. 154(b) by 0 days.

(21) Appl. No.: 10/658,761

(22) Filed: Sep. 10, 2003

(51) Int. Cl.[7] ..... B65D 25/08
(52) U.S. Cl. ..... 206/222
(58) Field of Search ..... 206/219–222, 206/568; 215/DIG. 8

(56) References Cited

U.S. PATENT DOCUMENTS 3,156,369 A * 11/1964 Bowes et al. ..... 206/222
3,603,469 A * 9/1971 Magni ..... 206/222
4,195,731 A * 4/1980 Cavazza ..... 206/222
6,367,622 B1 * 4/2002 Hsu ..... 206/222
6,454,088 B2 * 9/2002 Mollstam et al. ..... 206/222
6,513,650 B2 * 2/2003 Mollstam et al. ..... 206/222
6,705,462 B2 * 3/2004 Kasuya ..... 206/222

FOREIGN PATENT DOCUMENTS

TW 231632 8/1983

* cited by examiner

*Primary Examiner*—Luan K. Bui
(74) *Attorney, Agent, or Firm*—Birch, Stewart, Kolasch & Birch, LLP

(57) ABSTRACT

A container having separate storage chambers is disclosed having a main body containing a first substance, a lid member tightly engaged with the main body, an airtight member for encapsulation of at least a second substance, a holder assembly for retaining the airtight member therein, and an opener with a cutting portion for releasing the second substance from the airtight member. The lid member is in tight contact with the holder assembly so as to prevent spillage or leakage of the first substance. The airtight member can be cut open by the cutting portion of the opener, thereby releasing the encapsulation of the second substance and allowing mixture of the first and second substance in the main body, the opened-up airtight member remaining held by the holder.

20 Claims, 10 Drawing Sheets

CONTAINER HAVING SEPARATE STORAGE CHAMBERS

BACKGROUND OF THE INVENTION

1. Field of the Invention

The present invention relates to containers, and more particularly, to a container having separate storage chambers capable of keeping different ingredients separate before use.

2. Description of Related Art

Conventionally, when preparing formulas for daily use or consuming a beverage that requires mixing up formulas with additives, liquid solution, gas, or other ingredients, it is often necessary to separately tear open the packages containing additives or formulas that need to be mixed, such as Antabuse, fresh vitamin C powder, carbon dioxide., etc, and then add the formulas to the liquid solution, such as water, beauty lotion, oxygen, or other ingredients that need to be mixed before the mixture can be readily used or consumed. This procedure is rather troublesome and time-consuming.

In order to address the above-mentioned drawbacks, the TW Utility Publication No. 231632 discloses a container having separate storage chambers, wherein a lid member can seal the opening of a drinking bottle. Referring to FIG. 1, the container comprises a main body 1 containing a first substance 12 and a lid member 2, engaged with the main body 1. The lid member 2 comprises a sealing ring 22, a storage vial 3 extending through the sealing ring 22, a protective cap 5 enclosing the storage vial 3 to protect the storage vial 3 from being pressed, and a disposable sealing member 52 covering the lid member 2. The storage vial 3 having a storage chamber S for storage of a second substance 6 includes a vial body 31, a push bar (not labeled) sealing a top end thereof, and an opened end opposite to the push bar. The opened end of the storage vial 3 is sealed up by a sealing film 4 that is attached to the sealing ring 22. In use, the disposable sealing member 52 is first torn off, then the push bar is depressed to cut open the sealing film such that the second substance 6 falls into the first substance 12 and is mixed with the first substance 12. However, the lid member 2 is usually formed without a guide mechanism or a positioning mechanism for the storage vial 3, which easily result in the storage vial 3 overly rotating relative to the sealing ring 22, such that portions of the sealing film 4 are prone to be cut off and fall into the first substance 12, resulting in contamination of the first substance 12. Though the lid member 2 of the prior art improves on the drawbacks of the conventional mixing process and reduces packaging, it cannot ensure that the first substance 12 is free of contamination since the sealing film may be cut away and fall into the container.

In addition, the disposable sealing member 52 formed on the top of the protective cap 5 of the lid member 2 is not sealed airtight, which can only be achieved by means of precisely tight contact between the storage vial 3 and the sealing ring 2, which would necessitate increased manufacturing precision and thus increase the manufacturing costs. Furthermore, the tight contact between the storage vial 3 and the sealing ring 2 would likely make it difficult to depress the push bar for releasing the second substance 6.

To solve the above problems, an improved beverage container having separate storage chambers for receiving ingredients has been proposed. The beverage container comprises at least a main body (not labeled) and a lid member 9. Referring to FIG. 2, the lid member 9 comprises a sealing structure 111, two pieces of sealing film 113, and a push vial 117. The sealing structure 111, and the sealing films 113 jointly form a storage chamber S' for receiving ingredients 110 therein. In the case of a beverage container, the ingredients 110 are released from the storage chamber S' and are mixed up with the liquid solution contained in the beverage container by depressing the push vial 117 and cutting open both the sealing films 113. This necessitates a considerable amount of chamber for configuration of the push vial 117 and the storage chamber S' for receiving ingredients 110. As a result, the lid member 9 is not suitable for containers that are commonly used nowadays. In addition, such a lid member 9 is manufactured by a complicated molding process, resulting in unduly high manufacturing costs. Employing two pieces of sealing film 113 to store the ingredients 110 is also troublesome and inconvenient to implement. Thus, the problem of unduly high manufacturing and assembly costs is exacerbated.

FIG. 3 depicts another conventional container that is capable of separately storing a first substance 7 such as a liquid solution, and a second substance 8 such as ingredients. The first substance 7 can be mixed up with the second substance 8 by depressing and pulling a cap 9. An outlet 10*a* is defined in an opening 9*a* of the cap 9 for accessing the mixed first and second substances 7 and 8. In assembly of the container, the cap 9 is first attached to an upper body 11*a*. First and second engagement bodies 11*a*, 11*b*, and a cutting member 10 are assembled to the upper body 11*a* in order. The assembled upper body 11*a* is then secured to the lower body 11*b* to constitute the container, which is assembled by a number of individual parts. However, such a container cannot easily provide an airtight sealing effect due to its inherent complexity. Also, the process of assembling the container is unduly complicated and time-consuming. This design is also not suitable for application to existing containers. Furthermore, in view of the complicated assembly process, once the contents stored in the container are used up, it is troublesome to refill the container for repeated use.

SUMMARY OF THE INVENTION

In view of the above, an objective of the present invention is to provide a container having separate storage chambers, which has a simple structure and is easy to manufacture.

Another objective of the present invention is to provide a container having separate storage chambers which are reusable, and in which it is convenient for the user to access the mixed contents contained in the container.

Another objective of the present invention is to provide a container having separate storage chambers which is applicable to existing containers.

Another objective of the present invention is to provide a container having separate storage chambers which can provide a satisfactory airtight seal to preserve the contained substances from deterioration.

In order to achieve the above objectives, a container having separate storage chambers in accordance with the present invention comprises a main body containing a first substance, a lid member, an airtight member, a holder assembly, and an opener.

The main body has a storage chamber for accommodating a first substance, and an opening for accessing the storage chamber. The lid member is closely engaged with the main body. The lid member includes a cap, a circular peripheral ring adjacent to the cap, and a leakproof member disposed on an interior of the cap between the cap and the circular peripheral ring. The airtight member is for the tight encapsulation of a second substance to be mixed with the first substance.

The holder assembly is disposed within the opening of the main body. The holder assembly includes an outer part and an inner part. The outer part has an outer axial hole and a shoulder adapted for allowing the outer part to rest on the main body while providing tight contact between the shoulder and the leakproof member, so as to avoid spillage or leakage of the first substance. The inner part has an inner axial hole. The inner part is coaxially engaged in the outer axial hole of the outer part. Edges of the airtight enclosure are securely sandwiched between the inner and outer parts. The inner and outer parts respectively comprise positioning portions for ensuring a fixed interrelationship thereof and providing a reinforcement to hold the airtight enclosure.

The opener is coaxially disposed in the inner part. The opener includes a pressing portion around a top thereof, an active cutting portion around a bottom thereof for cutting open the airtight member, an inactive dull portion adjacent to the active cutting portion for preventing the airtight member from being completely cut off, and a through hole defined therein. The through hole is in communication with the inner axial hole, the opening, and the storage chamber. When the pressing portion is depressed to a point where the pressing portion is in contact with a top of the inner part, the airtight member is cut open by the cutting portion, thereby releasing the encapsulation of the second substance and allowing mixture of the first and second substances, with the opened-up airtight member remaining attached to the holder.

BRIEF DESCRIPTION OF THE DRAWINGS

Other objectives, advantages and novel features of the invention will become more apparent from the following detailed description when taken in conjunction with the accompanying drawings, in which.

DETAILED DESCRIPTION OF THE PREFERRED EMBODIMENTS

Reference will now be made to the drawings to describe the present invention in detail.

Figure 1:
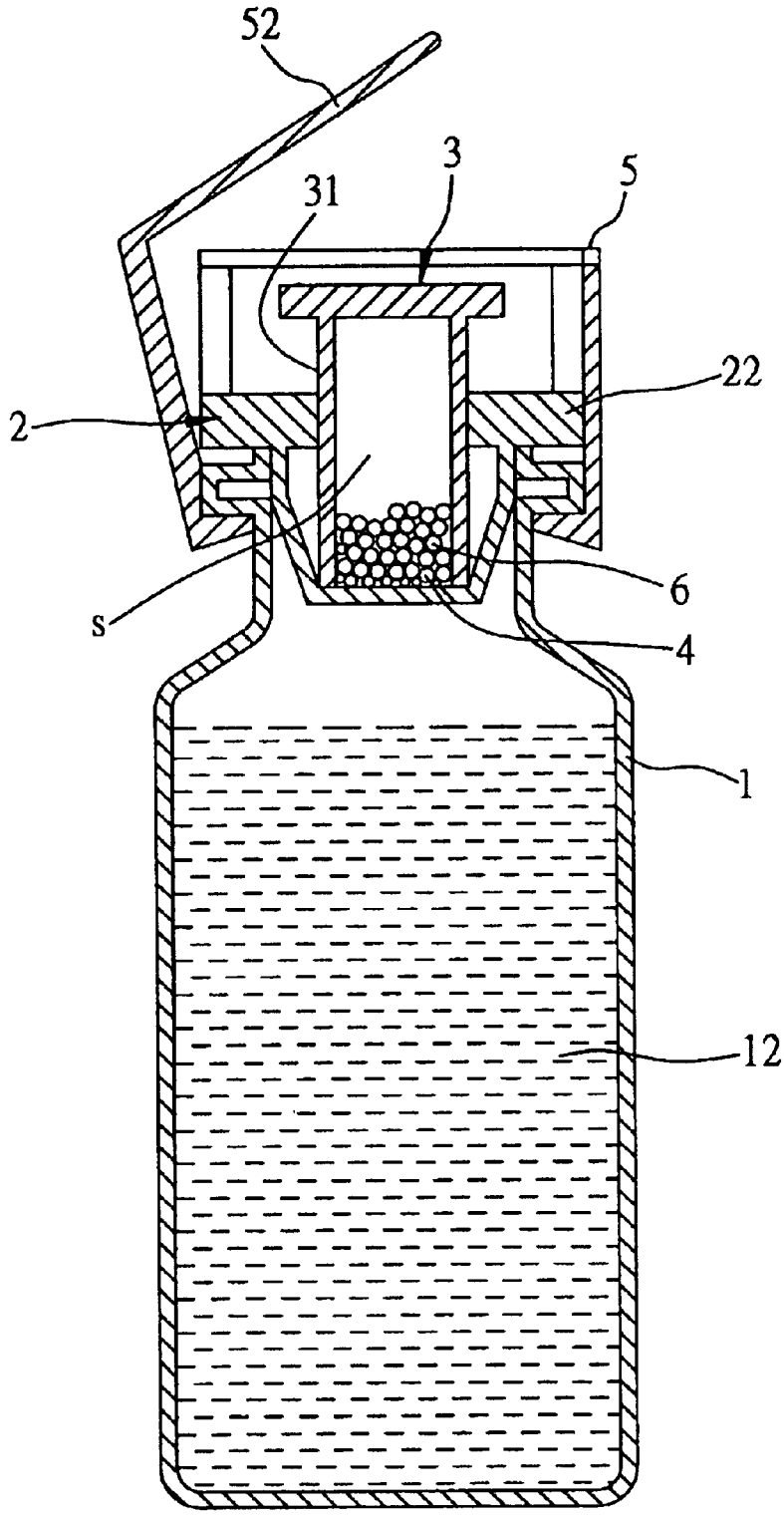
FIG. 1 (PRIOR ART)
FIG. 1 (PRIOR ART) is a cross-sectional view of a conventional container having separate storage chambers.
Figure 2:
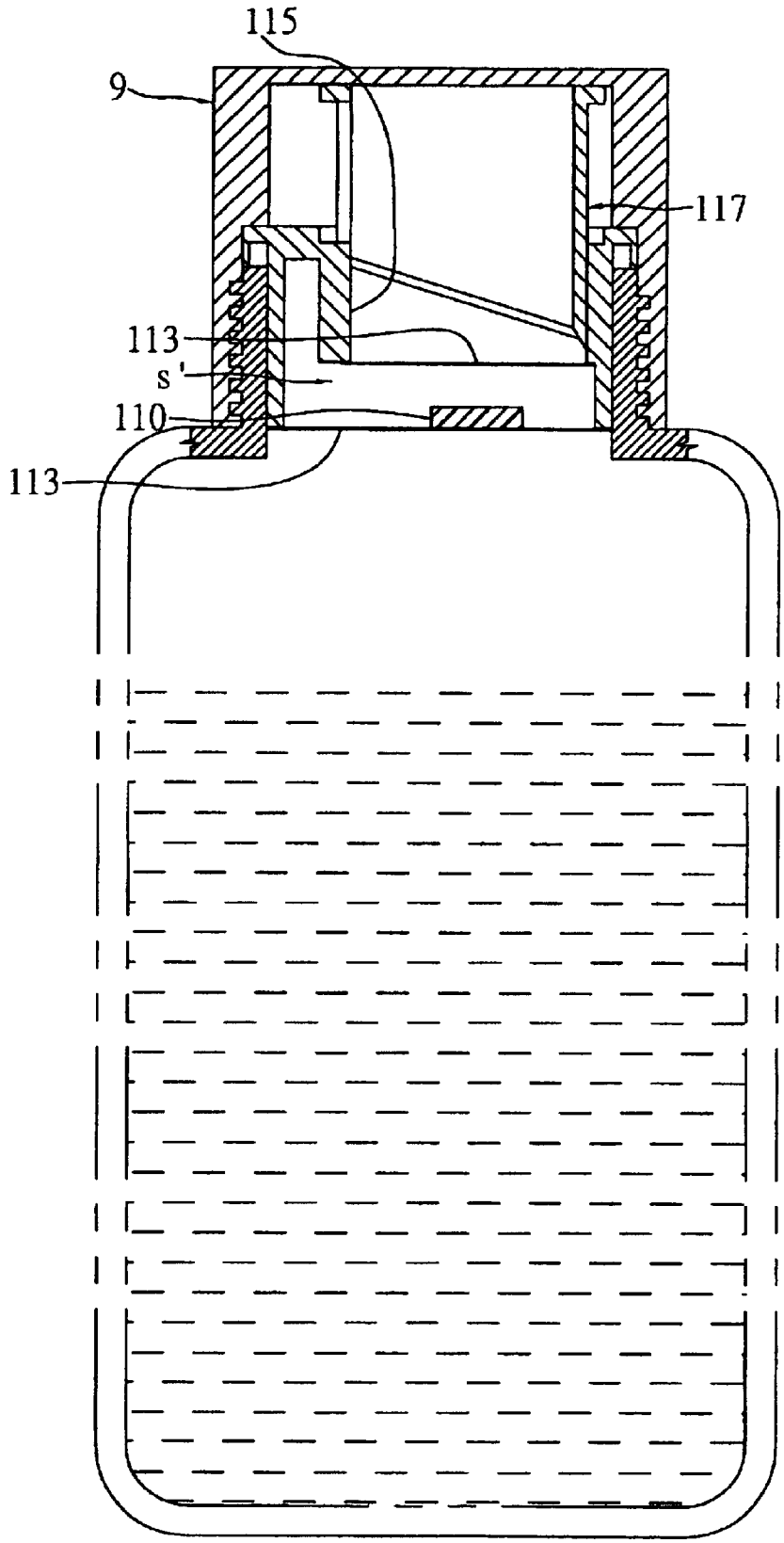
FIG. 2 (PRIOR ART)
FIG. 2 (PRIOR ART) is a cross-sectional view of another conventional container.
Figure 3:
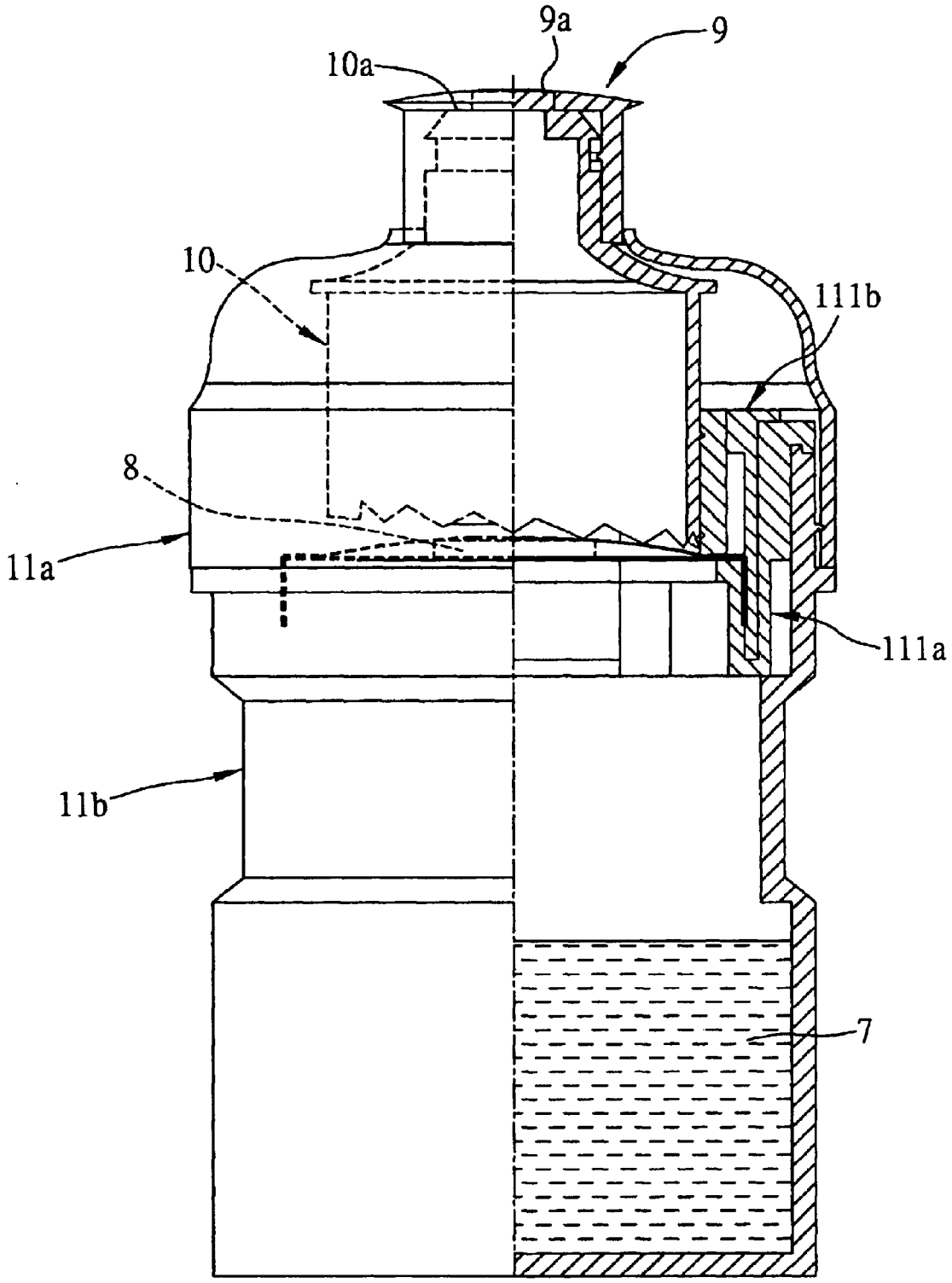
FIG. 3 (PRIOR ART)
FIG. 3 (PRIOR ART) is a partial section view of another conventional container.
Figure 4:
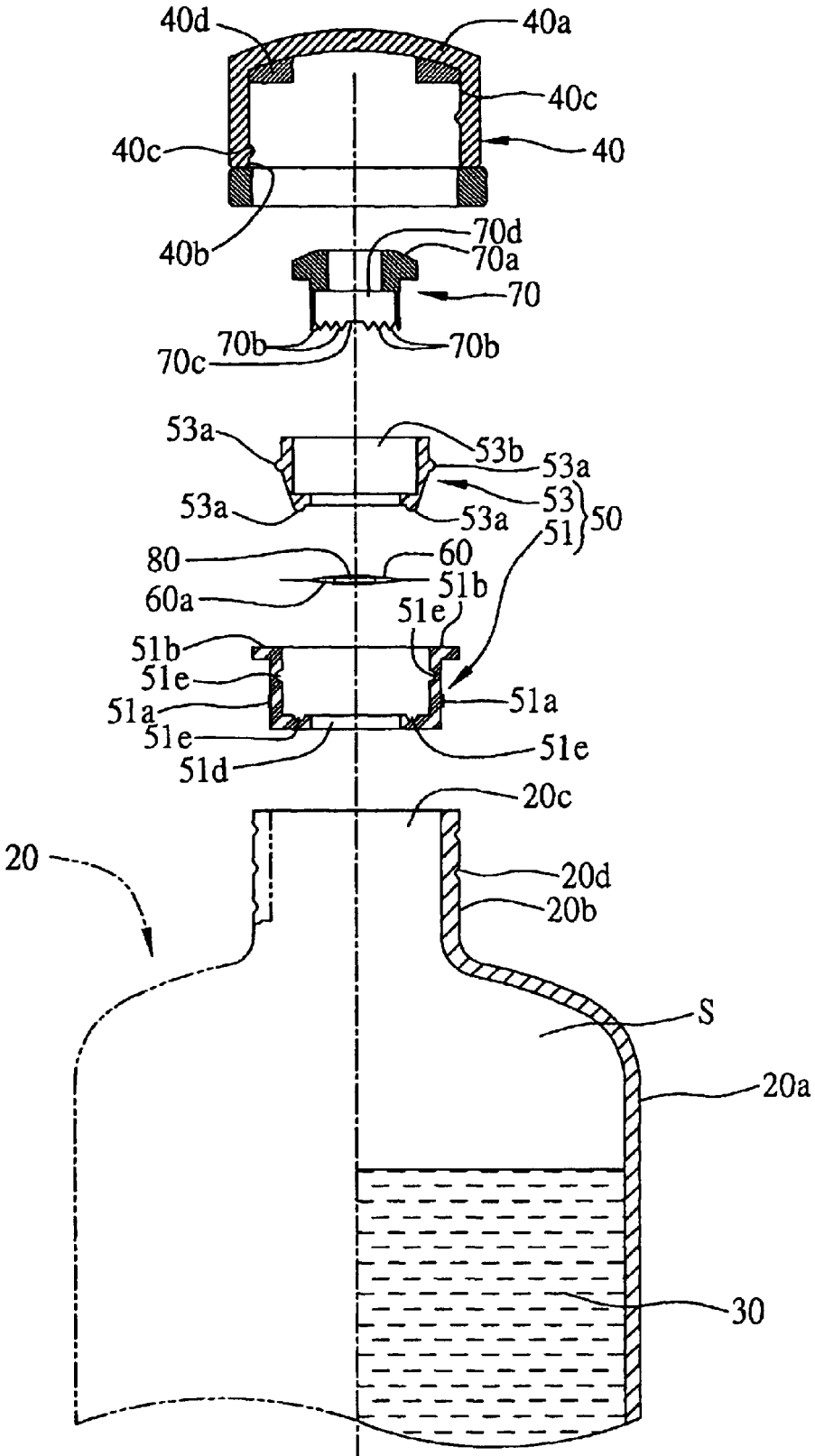
FIG. 4 is an exploded and partially sectioned view of a container having separate storage chambers in accordance with a first embodiment of the present invention.
Figure 5:
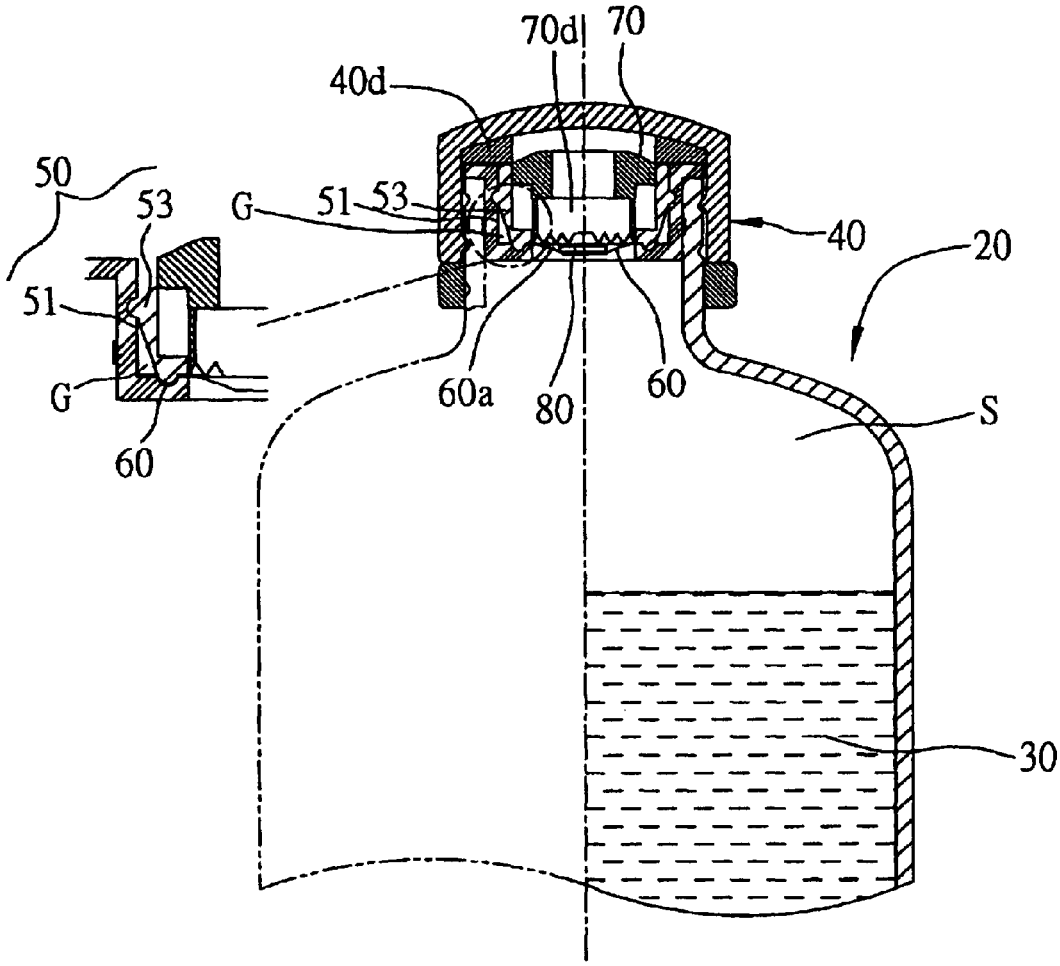
FIG. 5 is a partially sectioned, assembled view of the container of FIG. 4, and an enlarged view of a portion circled in FIG. 5.
Figure 6:
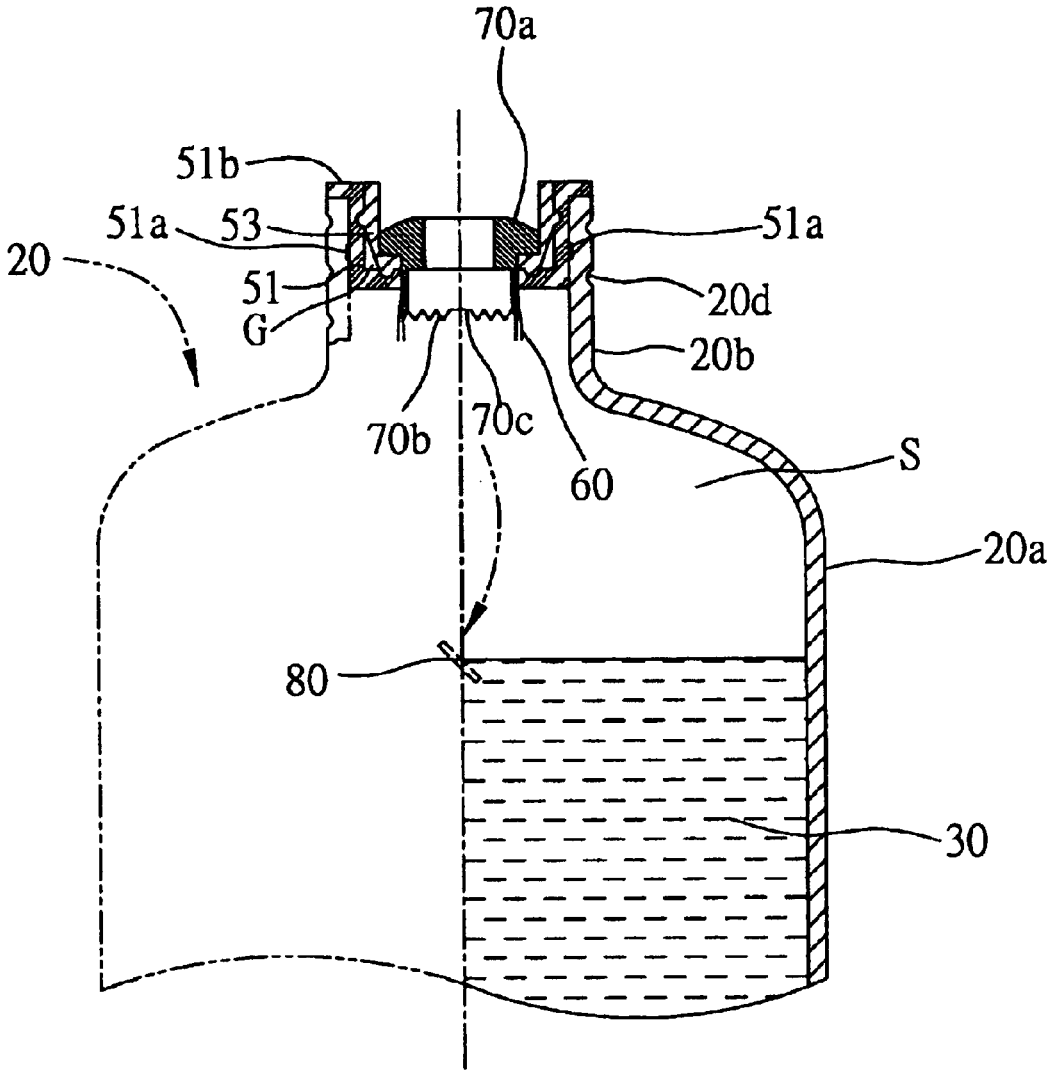
FIG. 6 is a schematic partially sectioned view of the container of FIG. 4, with the cutting member fully depressed down.

Referring to FIGS. 4–6, and particularly to FIG. 5, a container having separate storage chambers in accordance with a first embodiment of the present invention comprises a main body 20 for containing a first substance 30 therein, a lid member 40 tightly engaged with the main body 20, an airtight member 60 for encapsulation of a second substance 80, a holder assembly 50 for retaining the airtight member 60 therein, and an opener 70 adapted for releasing the encapsulation of the second substance 80.

Referring to FIG. 4, the main body 20 comprises a containing portion 20*a* defining a storage chamber S for receiving the first substance 30, a neck portion 20*b* adjacent to an upper part of the containing portion 20*a*, and an opening 20*c* in communication with the storage chamber S. A first thread 20*d* is defined in an outer surface of the neck portion 20*b*. The first substance can be in a gaseous state, a solid state, a liquid state, or any combination thereof.

The lid member 40 comprises a cap 40*a*, a circular periphery 40*b* adjacent to the cap 40*a*, a second thread 40*c*, and a circular leakproof member 40*d* disposed in an interior of the cap 40*a*. The leakproof member 40*d* can be integrally formed in an inner surface of the cap 40*a*, for enhancing airtight contact between the cap 40*a* and the opening 20*c*. The second thread 40*c* is defined in an inner surface of the lid member 40, for threaded engagement with the first thread 20*d* of the main body 20.

Referring also to FIG. 5, the holder assembly 50 comprises an outer part 51 and an inner part 53. The inner part 53 is detachably and coaxially disposed in the outer part 51. The assembled inner and outer parts 53, 51 are received in the opening 20*c* of the main body 20. The outer part 51 comprises a first engaging portion 51*a*, a shoulder 51*b*, an outer axial hole 51*d*, and two first positioning portions 5*e* (FIG. 4). The first engaging portion 51*a* is formed in an outer surface of the outer part 51, and is shaped and spaced apart with the point protrusions for allowing the outer part 51 to fixedly engage with the neck portion 20*b*. Alternatively, the outer part 51 may be engaged in the opening 20*c* when the present invention applies to a main body that does not have a neck portion. Alternatively, the first engaging portion 51*a* may be contiguous or spaced-apart flanges, protrusion blocks or any other suitable configurations. The number of protrusions and structure of the first engaging portion 51*a* are exemplified for illustration purposes only, and are not intended to limit the present invention.

The shoulder 51*b* formed on a top of the outer part 51 extends outwardly such that the holder assembly 50 can rest on the neck portion 20*b* of the main body 20 via the shoulder 51*b*. Preferably, the shoulder 51*b* is in tight contact with the leakproof member 40*d* of the lid member 40; so as to prevent leakage and spillage of the first substance 30 contained in the main body 20 through the opening 20*c*. The outer axial hole 51*d* defined in the outer part 51 is in a round shape. The outer axial hole 51*d* is for allowing the mixture of the first and second substances 30, 80 to freely flow therethrough.

The first positioning portions 51*e* are disposed in both the inner surface and the bottom of the outer part 51, respectively. The first positioning portions 51*e* generally take the shape of spaced-apart depressions. It should be noted that the number and the structure of the first positioning portions 51*e* are exemplified herein for illustration purposes only, and are not intended to limit the present invention.

The inner part 53 comprises two second positioning portions 53*a* corresponding to the first positioning portions 51*e* and a round inner axial hole 53*b* defined therein. The inner axial hole 53*b* is in communication with the opening

20*c* and the storage chamber S. The second positioning portions 53*a* generally take the shape of spaced-apart protrusions formed in an outer surface of the inner part 53 for tight engagement with the first positioning portions 51*e*. Referring to FIG. 5, the inner part 53 is engagingly received in the outer part 51 such that gaps are formed between the inner and outer parts 53 and 51 for accommodating circumferential portions of the airtight member 60. Due to the engagement between the first positioning portions 51*e* and the second positioning portions 53*a*, the inner part 53 is non-rotatable relative to the outer part 51. An area of the circumferential portions of the airtight member 60 is sandwiched between the first positioning portion 51*e* and the second positioning portion 53*a*, and the remainders thereof are accommodated in the gaps. Consequently, the airtight member 60 is securely retained in the holder assembly 50.

The inner axial hole 53*b* of the inner part 53 is for allowing the mixture of the first and second substances to freely flow therethrough. The shape of the inner axial hole 53*b* is exemplified for illustration purposes only, and is not intended to limit the present invention.

The airtight member 60 comprises a containing portion 60*a* encapsulating the second substance 80. The containing portion 60*a* is preferably capable of separately containing at least one substance. The airtight member 60 is preferably made of materials selected from the group consisting of aluminum foil, plastic film, and paper. Alternatively, the second substance 80 can be in a gaseous state, a liquid state, a solid state, or any combination thereof. Referring to FIGS. 4–5, the opener 70 is coaxially slidably received in the inner part 53 of the holder assembly 50. The opener 70 comprises a pressing portion 70*a* at a top thereof, an active cutting portion 70*b* at a bottom thereof, an inactive dull portion 70*c* interposed between the active cutting portion 70*b*, and a through hole 70*d*. The through hole 70*d* is in communication with the opening 20*c*, the inner axial hole 53*b*, and the storage chamber S. The pressing portion 70*a* is shaped to be a semi-spherical protrusion. A distance between the pressing portion 70*a* and the top of the inner part 53 is greater than a distance between the active cutting portion 70*b* and the airtight member 60.

The active cutting portion 70*b* comprises a plurality of sharp tips for penetrating and cutting open the airtight member 60 to release and allow the second substance 80 to mix with the first substance 30. The structure of the active cutting portion 70*b* is exemplified herein for illusion only, and is not intended to limit the invention of this embodiment. Understandably, the inactive dull portion is for preventing the airtight member from being completely cut off.

Referring to FIGS. 5–6, when in use, a user simply needs to depress the pressing portion 70*a* of the opener 70 such that first portions of the airtight member 60 corresponding to the active cutting portion 70*b* of the opener 70 are cut open by the sharp tips. The second substance 80 then falls into and mixes with the first substance 30, wherein second portions of the airtight member 60 corresponding to the inactive dull portion 70*c* of the opener 70 remain intact, thereby allowing the second portion of the airtight member 60 to remain held by the holder assembly, thus completing the description of the first embodiment.

Referring to FIGS. 7–11, a container having separate storage chambers in accordance with a second embodiment of the present invention comprises a main body 20' for receiving a first substance, a lid member 40' tightly engaged with the main body 20', an airtight member 60' for encapsulation of a second substance 80', a holder assembly 50' for retaining the airtight member 60' in position, and an opener 70' for releasing the encapsulation of the second substance 80'. Other parts are the same as or equivalent to similar parts in the container system according to the first embodiment of the invention. It should be noted that like parts in this and the first embodiment are identified by like reference numeral, and further description thereof is thus omitted below.

Most part of the structure of the container of the second embodiment is similar to the container of the first embodiment. The difference in the second embodiment is that the holder assembly 50*c*' further comprises a plurality of spaced first mating portions 51*c*' formed on the inner surface of the outer part 51'; with reference to FIGS. 7–10, the first mating portions 51*c*' are shown as, but not limited to, four hollow portions (FIG. 8) that are evenly arranged in the bottom of the outer part 51'. The inner part 53' of the holder assembly 50*c*' further comprises a plurality of second mating portions 53*c*' on the outer surface thereof, which are shown as downwardly tapered tabs extending from the bottom of the inner part 53' and can be engaged with the first mating portions 51*c*' of the outer part 51'. By the engagement between the first and second mating portions 51*c*', 53*c*', the second substance 80' received in the airtight member 60' can be held in the holder assembly 50*c*'. The number and shape of the first and second mating portions 51*c*', 53*c*' are flexibly adjusted as long as the engagement in-between can firmly secure the airtight member 60' in position not dropping into the storage chamber S' of the main body 20'.

Figure 7:
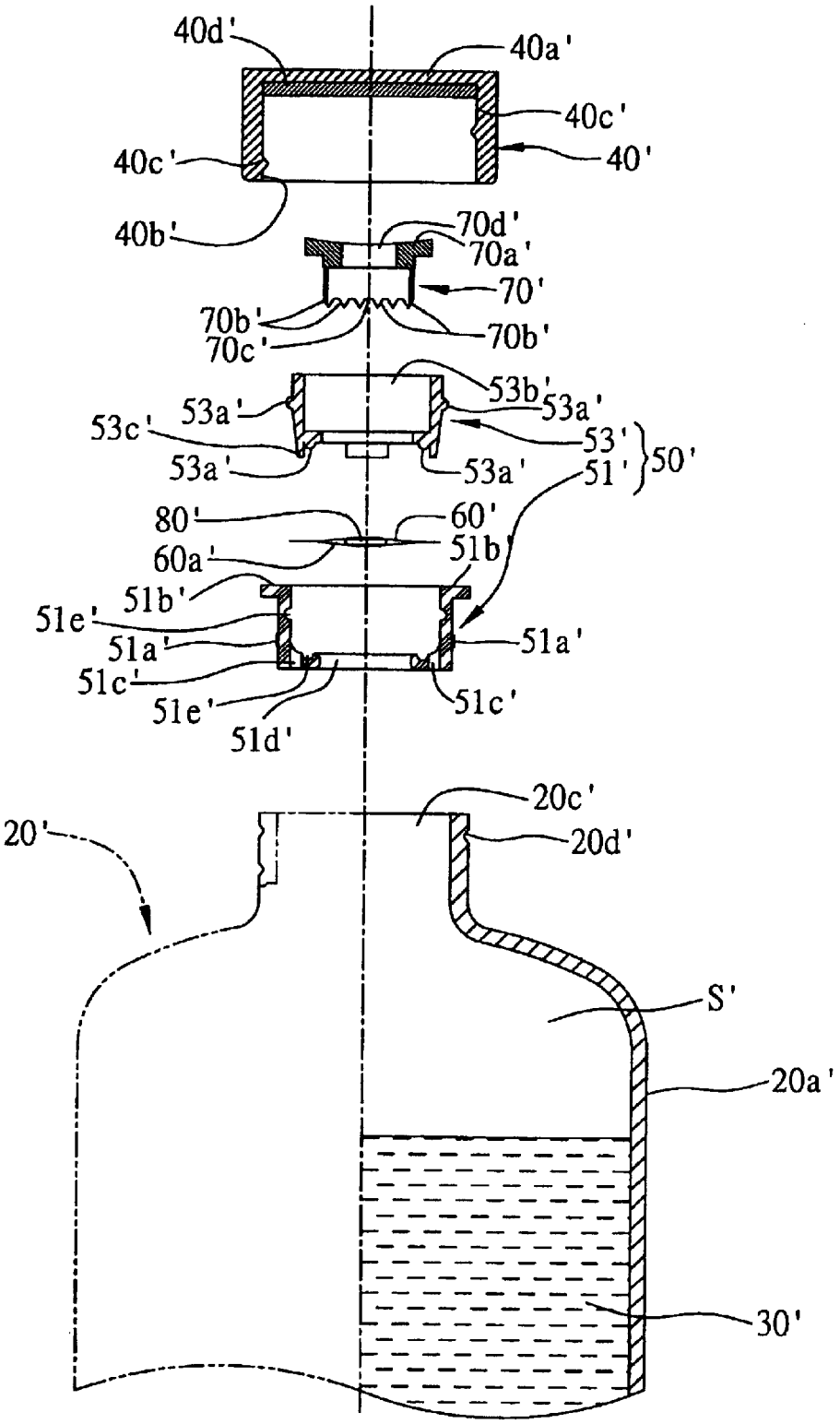
FIG. 7 is an exploded and partially sectioned view of a container having separate storage chambers in accordance with a second embodiment of the present invention.
Figure 8:
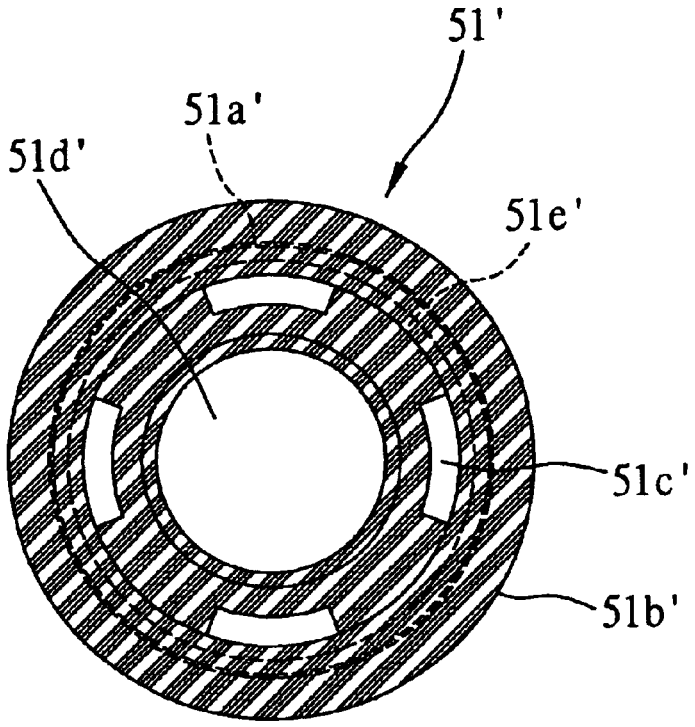
FIG. 8 is a top view of an outer part of FIG. 7.
Figure 9:
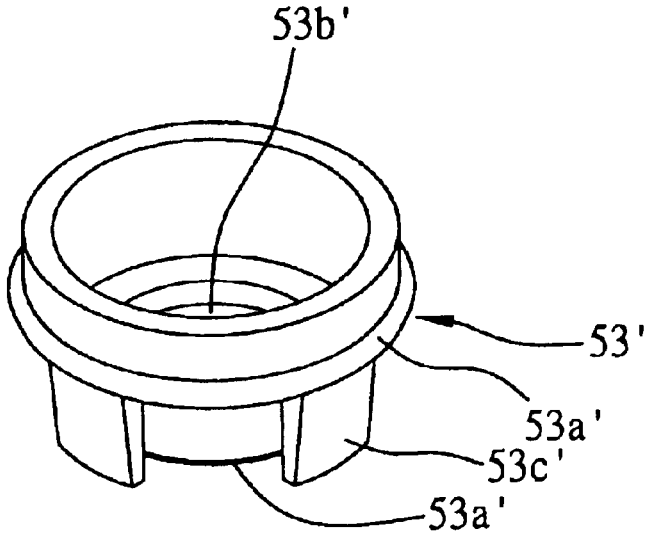
FIG. 9 is an isometric view of an inner part of FIG. 7.
Figure 10:
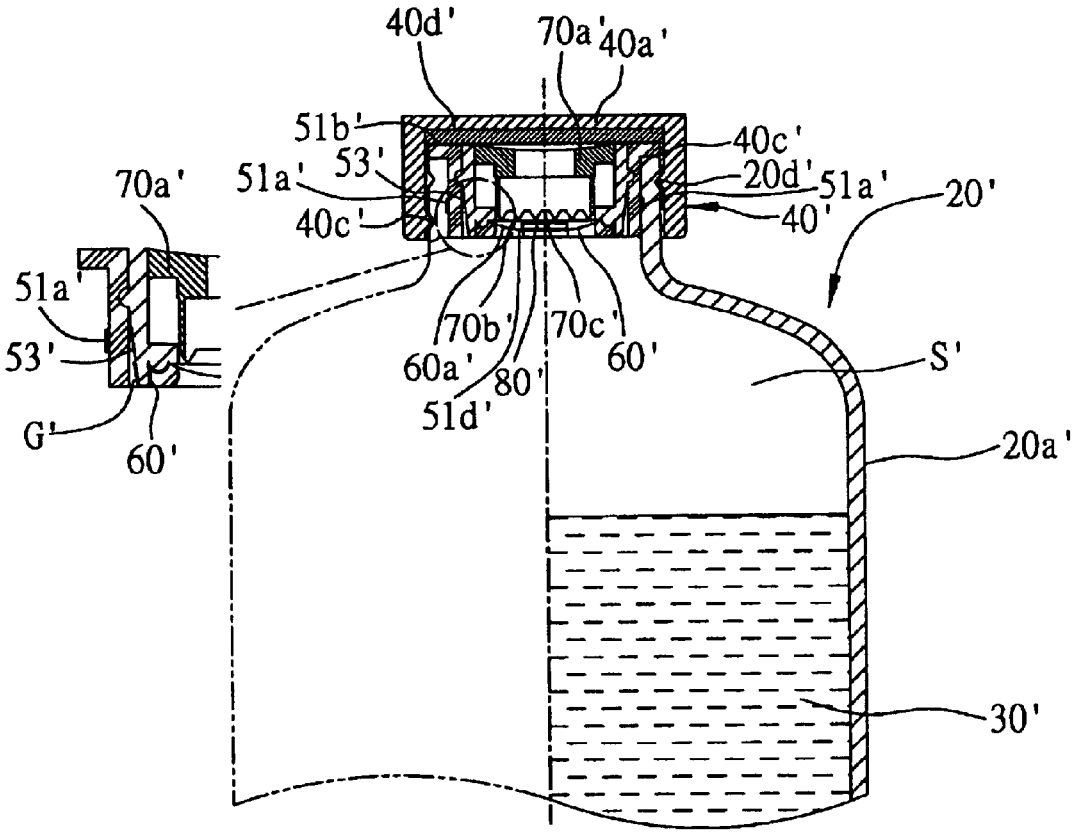
FIG. 10 is a partially sectioned, assembled view of the container of FIG. 7, and an enlarged view of a portion circled in FIG. 10.
Figure 11:
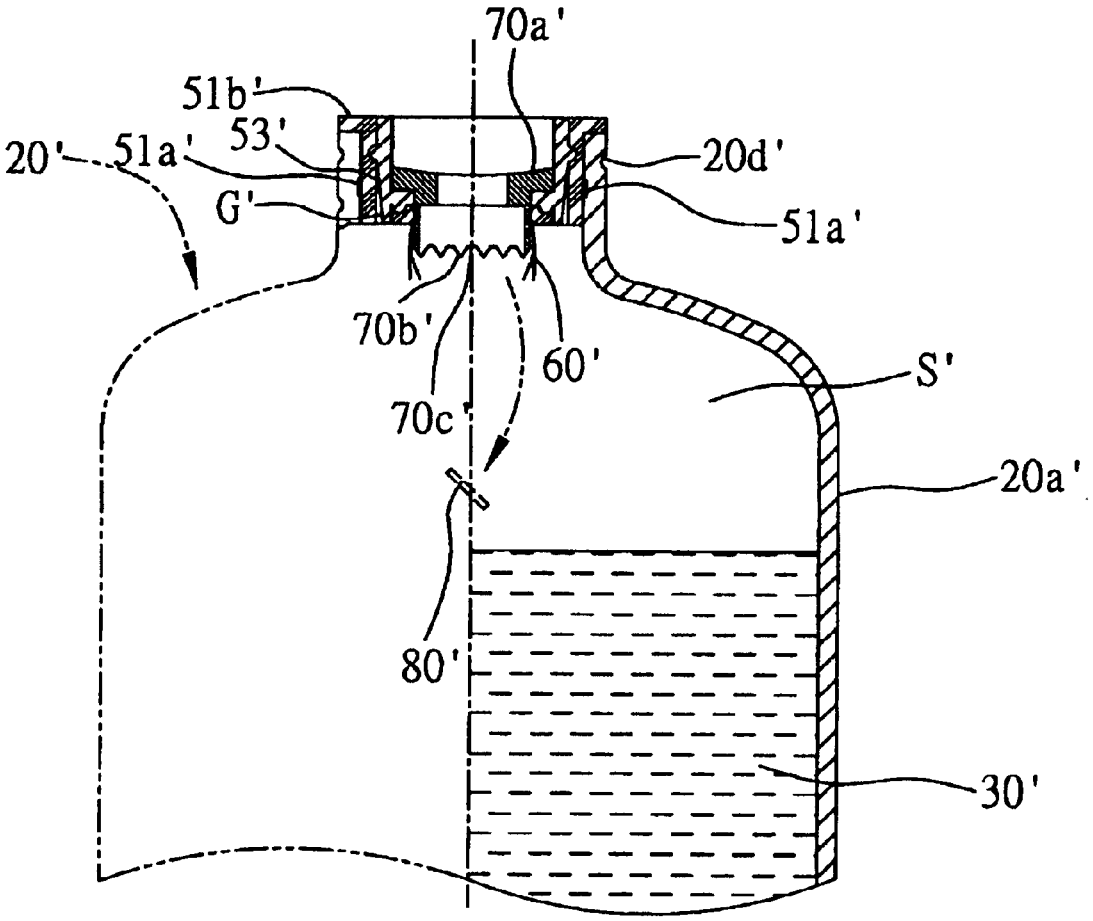
FIG. 11 is a schematic partially sectioned view of the container of FIG. 7, with the cutting member fully depressed down.

Referring to FIG. 7, the opener 70' comprises a pressing portion 70*a*' that is substantially flush with a top of the holder assembly 50'. The pressing portion 70*a*' is generally a semi-spherical depression for facilitating depression. A distance between the pressing portion 70*a*' and a bottom of the lid member 40' is greater than a distance between the active cutting portion 70*b*' and the airtight member 60'. The main body 20' of the second embodiment is similar to the main body 20 of the first embodiment, except that the main body 20' does not include a neck portion. The leakproof member 40*d*' is generally a leak proof film disposed in an interior of the lid member 40'. The operation of the container of the second embodiment is similar to the container of the first embodiment, and the detailed description is thus omitted.

While the preferred embodiment in accordance with the present invention has been shown and described, equivalent modifications and changes known to persons skilled in the art according to the spirit of the present invention are considered to be within the scope of the present invention as defined in the appended claims.

What is claimed is:

1. A container having separate storage chambers, comprising:

a main body having a storage chamber for accommodating a first substance, and an opening in communication with the storage chamber;

a lid member for being engaged with the main body, the lid member comprising a cap, a circular ring adjoining the cap, and a leakproof member connected to the cap and surrounded by the circular ring;

an airtight member having a containing portion for receiving a second substance that is to be mixed with the first substance;

a holder assembly disposed within the opening of the main body, the holder assembly comprising an outer part and an inner part coaxially engaged with an outer axial hole of the outer part, allowing the airtight member to seal an inner axial hole of the inner part and fixed in the holder assembly, wherein the outer part has a shoulder formed across the main body, to allow the shoulder to closely abut against the leakproof member when the lid member is engaged with the main body so as to prevent the first substance from leaking through the opening; and an opener coaxially disposed in the inner part of the holder assembly, the opener comprising a pressing portion formed at a top thereof, at least one active cutting portion formed at a bottom thereof, at least one inactive dull portion adjacent to the active cutting portion, and a through hole in communication with the storage chamber, the opening, and the inner axial hole;

wherein when the pressing portion is depressed to come into contact with a bottom of the inner part of the holder assembly, the active cutting portion cuts open a predetermined part, defined by the inactive dull portion, of the airtight member to release the second substance to the storage chamber where the second substance is mixed with the first substance and to prevent the airtight member from dropping into the storage chamber.

2. The container as described in claim 1, wherein the first or second substance is selected from the group consisting of a gas, liquid, solid, and mixture thereof.

3. The container as described in claim 1, wherein the leakproof member is selected from the group consisting of a ring-shaped member integrally formed with the cap, and a leakproof film.

4. The container as described in claim 1, wherein the airtight member is made of a material selected from the group consisting of aluminum foil, plastic film, and paper.

5. The container as described in claim 1, wherein the outer part of the holder assembly comprises a plurality of first engaging portions arranged on an outer surface thereof.

6. The container as described in claim 5, wherein the first engaging portions are contiguously arranged or spaced from each other, and selected from the group consisting of flanges, protrusion blocks, roughened structures, and point protrusions.

7. The container as described in claim 1, wherein the outer axial hole of the outer part of the holder assembly has a circular shape, and the shoulder is formed on a top of the outer part and extends outwardly to cross the main body.

8. The container as described in claim 1, wherein the outer part of the holder assembly comprises a plurality of spaced first mating portions formed on an inner surface thereof.

9. The container as described in claim 8, wherein the first positioning portions are structured as hollow portions.

10. The container as described in claim 1, wherein the outer part of the holder assembly comprises at least one first positioning portion formed on an inner surface thereof, and the inner part comprises at least one second positioning portion that is formed on an outer surface thereof and corresponding in position to the first positioning portion.

11. The container as described in claim 10, wherein the first positioning portion is a depression, and the second positioning portion is a protrusion to be engaged with the first positioning portion, allowing the airtight member to be clamped between the first positioning portion and the second positioning portion.

12. The container as described in claim 10, wherein the first positioning portion is a protrusion, and the second positioning portion is a depression to be engaged with the first positioning portion allowing the airtight member to be clamped between the first positioning portion and the second positioning portion.

13. The container as described in claim 10, wherein the first positioning portion is located at a bottom of the outer part, and the second positioning portion is located at the bottom of the inner part.

14. The container as described in claim 8, wherein the inner part of the holder assembly comprises a plurality of second mating portions to be engaged with the first mating portions of the outer part so as to secure the inner part in position.

15. The container as described in claim 14, wherein the second mating portions are downwardly tapered structures.

16. The container as described in claim 1, wherein the inner axial hole of the inner part is in communication with the storage chamber and the opening of the main body, to allow the mixed first and second substances to freely move to the storage chamber and the opening.

17. The container as described in claim 1, wherein the pressing portion is shaped as a semi-spherical protrusion on the top of the opener.

18. The container as described in claim 1, wherein the pressing portion is shaped as a semi-spherical depression on the top of the opener.

19. The container as described in claim 1, wherein the active cutting portion comprises a plurality of tips.

20. The container as described in claim 19, wherein the inactive dull portion is disposed between two of the tips that are adjacent to each other, to define the predetermined part of the airtight member being cut open by the active cutting portion.

* * * * *